US007731350B2

(12) United States Patent
Yamamoto

(10) Patent No.: US 7,731,350 B2
(45) Date of Patent: Jun. 8, 2010

(54) INK JET PRINTER

(75) Inventor: Eiji Yamamoto, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 711 days.

(21) Appl. No.: 11/585,900

(22) Filed: Oct. 25, 2006

(65) Prior Publication Data

US 2007/0091158 A1 Apr. 26, 2007

(30) Foreign Application Priority Data

Oct. 26, 2005 (JP) ..... 2005-311796

(51) Int. Cl.
*B41J 29/38* (2006.01)
*B41J 2/01* (2006.01)
*B65H 3/44* (2006.01)
*B65H 1/00* (2006.01)

(52) U.S. Cl. ..... 347/104; 347/16; 271/9.12; 271/171

(58) Field of Classification Search ..... 271/9.12; 347/104, 262

See application file for complete search history.

(56) References Cited

U.S. PATENT DOCUMENTS 5,199,695 A * 4/1993 Nakahata et al. ..... 271/9.12
5,433,425 A * 7/1995 Kubota et al. ..... 271/9.12
2003/0179257 A1* 9/2003 Inui et al. ..... 347/19

FOREIGN PATENT DOCUMENTS

JP 6-340137 A 12/1994
JP 9-18662 A 1/1997

* cited by examiner

*Primary Examiner*—Matthew Luu
*Assistant Examiner*—Kendrick X Liu
(74) *Attorney, Agent, or Firm*—Crowell & Moring LLP

(57) ABSTRACT

A partition is provided at the almost center of a parallel sheet feed tray in a main-scanning direction, and recording paper sheets such as postcards are mounted in two rows in parallel in the main-scanning direction. By bringing upper surfaces of the recording paper sheets into contact with a pick roller, the recording paper sheets are picked one by one per row and fed toward an inside of a housing. While the recording paper sheets are conveyed in a sub-scanning direction with being arranged in parallel in the main-scanning direction, ink drops are discharged to both the recording paper sheets with reciprocation of a carriage with the ink cartridges in the main-scanning direction. Images are formed on the two recording paper sheets simultaneously, thereby shortening time necessary for printing a lot of recording paper sheets.

6 Claims, 2 Drawing Sheets

INK JET PRINTER

BACKGROUND OF THE INVENTION

1. Field of the Invention

The present invention relates to an ink jet printer for forming an image on a recording paper sheet with a recording head mounted on a reciprocating carriage.

2. Description of the Related Art

Conventionally, there has been used an ink jet printer which forms an image on a recording paper sheet by discharging ink drops from a recording head while reciprocating a carriage which mounts the recording head thereon in a direction (hereinafter referred to as a main-scanning direction) perpendicular to a recording paper sheet conveying direction (hereinafter referred to as a sub-scanning direction). Such ink jet printer is constituted that an image can be formed on a recording paper sheet of various sizes, for example, from A4 size to postcard size.

However, although such a conventional ink jet printer is constituted to form an image on the recording paper sheet of, for example, of A4 size at a maximum one by one, even when an image is formed on a small recording paper sheet such as a postcard, the recording paper sheet is fed from a paper sheet feed tray one by one, an image is formed on the recording paper sheet and the printed recording paper sheet is ejected to a paper sheet exit tray. Thus, especially when images are formed on a lot of postcards, it takes a long time to complete image formation. In such an ink jet printer, to miniaturize an ink jet printer main body, the number of recording paper sheets which can be mounted on the paper sheet feed tray is limited. Thus, when images are formed on a lot of recording paper sheets, it is necessary to frequently fill the paper sheet feed tray with the recording paper sheets, thereby causing inconvenience to the user.

For example, Unexamined Patent Publication No. 6-340137 describes a laser printer in which printing speed is improved by processing some printing operations in parallel. However, in the laser printer, recording units for carrying out printing are provided in parallel. Thus, the laser printer has a complicated configuration and requires high costs.

SUMMARY OF THE INVENTION

In consideration with the above-mentioned problems, the present invention intends to provide an inexpensive ink jet printer capable of mounting a lot of recording paper sheets on a paper sheet feed tray and performing an image forming operation for a short time.

An ink jet printer in accordance with an aspect of the present invention comprises:

a carriage which mounts at least a recording head for discharging ink drops and is provided in a housing so as to be movable in a main-scanning direction;

a carriage driving mechanism for reciprocating the carriage in the main-scanning direction;

a paper sheet feed tray for mounting recording paper sheets thereon, having a partition which partitions an area where the recording paper sheets are mounted into two in the main-scanning direction and enabling the recording paper sheets to be mounted in two rows in parallel in the main-scanning direction with the partition being placed therebetween; and a recording paper sheet conveying mechanism for conveying the recording paper sheets mounted on the paper sheet feed tray in two rows one by one per row in a sub-scanning direction perpendicular to the main-scanning direction under a state arranged in parallel in the main-scanning direction.

With such a configuration, since the recording paper sheets mounted on the paper sheet feed tray in two rows in parallel are conveyed in the sub-scanning direction with being arranged in parallel in the main-scanning direction and images are formed on the two recording paper sheets, as described above. Thus, the image forming operation can be carried out in a short time. Furthermore, it is possible to reduce the number of times the recording paper sheets are filled in the parallel paper sheet feed tray, thereby improving the convenience of the ink jet printer. Moreover, since this ink jet printer has the same configuration as the conventional printers except that the partition is formed at the almost center of the paper sheet feed tray in the main-scanning direction, it is possible to provide the ink jet printer capable of forming images on two recording paper sheets at the same time at low costs.

DETAILED DESCRIPTION OF THE EMBODIMENT

Figure 1:
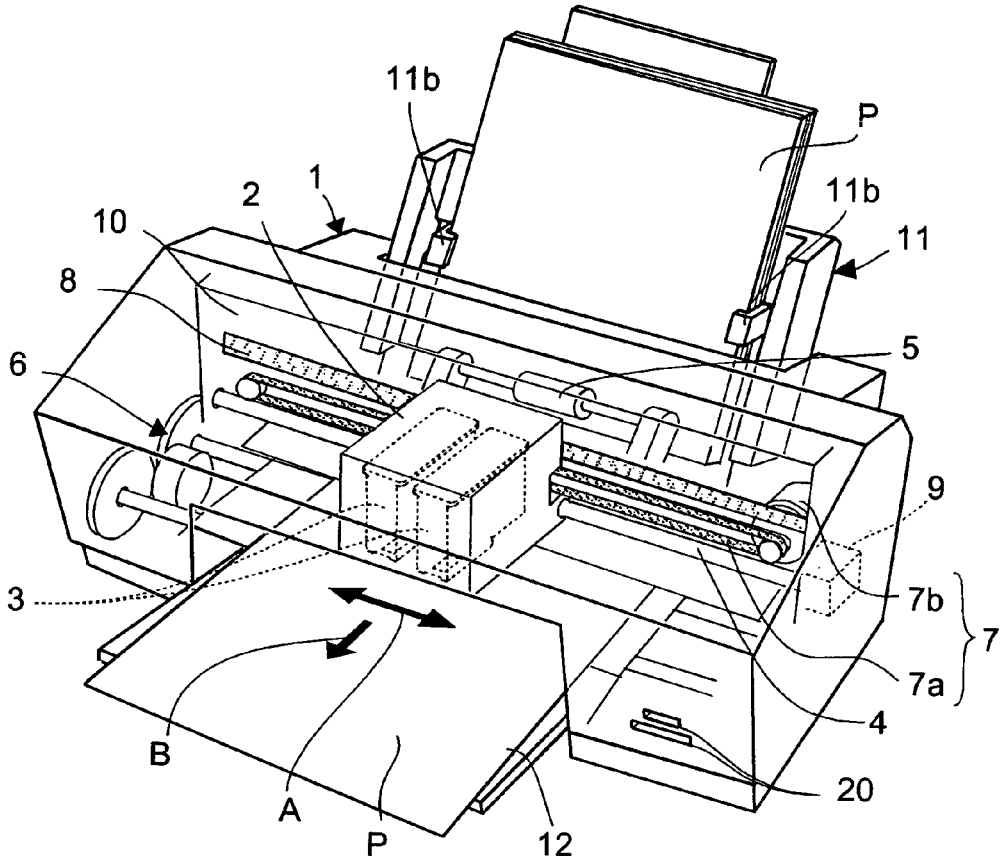
FIG. 1 is a perspective view showing a configuration of an ink jet printer in accordance with an embodiment of the present invention.

An ink jet printer in accordance with an embodiment of the present invention will be described with reference to figures. FIG. 1 shows an example of an ink jet printer in this embodiment. The ink jet printer 1 forms an image on a recording paper sheet P conveyed in a sub-scanning direction (shown by an arrow B in the figure) perpendicular to a main-scanning direction (shown by an arrow A in the figure) by reciprocating a carriage 2 which mounts ink cartridges 3 each having a recording head (not shown) for discharging ink drops therein in the main-scanning direction.

The ink jet printer 1 has a paper sheet feed tray 11 for mounting the recording paper sheets P to be printed thereon in a rear face side of a housing 10 and a paper sheet exit tray 12 for ejecting the printed recording paper sheet P below a front surface of the housing 10.

The ink jet printer 1 can form an image on the recording paper sheet P of A4 size at a maximum, for example. As shown in the figures, the recording paper sheets P are mounted on the paper sheet feed tray 11 so that shorter sides of the sheets P may be located in the main-scanning direction, that is, longitudinal direction of the recording paper sheets P. The recording paper sheets P are mounted on the paper sheet feed tray 11 so as to be positioned at the almost center of the paper sheet feed tray 11 in the main-scanning direction by two guide claws 11*b* provided to be slidable in the main-scanning direction.

In the housing 10 of the ink jet printer 1, a shaft 4 is disposed on a rear face side of the carriage 2 so that the longitudinal direction of the shaft 4 is the main-scanning direction. The carriage 2 mounting the ink cartridges 3 is reciprocally moved in the main-scanning direction along the shaft 4 by a driving force generated by a carriage driving mechanism 7. An encoder scale 8 which is used to detect the position of the carriage 2 in the main-scanning direction is disposed on the housing 10 along the shaft 4 in the main-scanning direction. A pick roller 5 for picking up a recording paper sheet one by one from the paper sheet feed tray 11 is provided in the housing 10 at the almost center of the paper sheet feed tray 11 in the main-scanning direction so as to be opposed to the recording paper sheet P mounted on the paper sheet feed tray 11. A recording paper sheet conveying mechanism 6 is further provided in the housing 10 so as to convey the recording paper sheet P which is picked by the pick roller 5 into the housing 10. A control circuit 9 controls various operations of the ink jet printer 1.

The ink jet printer 1 is connected to, for example, an external personal computer (not shown) and as described later, has a function of forming an image or images on the recording paper sheet P or sheets P1 and P2 on the basis of data and a command which are transmitted from the personal computer or the like. The ink jet printer may have connectors 20 to which various kinds of memory cards storing image data can be inserted. Thereby, the ink jet printer 1 can form images on the recording paper sheets without using the external personal computer.

The carriage 2 is slidably engaged with the shaft 4. As described later, the carriage 2 is connected to a part of a belt 7*a* of the carriage driving mechanism 7 and disposed along the shaft 4 so as to be movable in the main-scanning direction. The carriage 2 mounts a photo-coupler (not shown) therein and the photo-coupler scans on the encoder scale 8 having a predetermined resolution, thereby detecting the position of the carriage 2 in the main-scanning direction. The carriage 2 has inside spaces and the ink cartridges 3 can be attached to and detached from the spaces. The ink cartridges 3 each has at least an ink tank for storing ink therein. On a lower surface of each ink cartridge 3 is provided a recording head having a plurality of nozzles for ejecting drops of the ink stored in the ink tank. The configuration of the carriage 2 is not limited to such configuration. For example, the carriage 2 may be configured so as to have a recording heads and allow the recording heads to discharge drops of the inks supplied from the ink cartridges 3 which are held on the carriage 2 or the housing 10 and have no recording head.

In this embodiment, the ink cartridges 3 are one which fills black ink therein and one which fills color inks of three colors including cyan, magenta and yellow, and are mounted on the carriage 2. That is, the ink jet printer 1 can form a color image on the recording paper sheet P. The configuration of the ink cartridges 3 mounted on the carriage 2 is not limited to this. For example, black ink and color inks may be collectively filled in one ink cartridge or color inks of each color may be separately filled in corresponding different ink cartridges. Alternatively, in this ink jet printer 1, only the ink cartridge 3 which fills black ink therein may be mounted in the carriage 2 to form, for example, a gray scale image.

The pick roller 5 is substantially cylindrical and a surface of the roller 5 is made of a rubber or the like so as to be hard to slip on a contact surface of the recording paper sheet P when coming into contact with the recording paper sheet P. The pick roller 5 is rotated around a rotational axis parallel to the main-scanning direction. The pick roller 5 can be rotated in connection with the recording paper sheet conveying mechanism 6 described later.

The carriage driving mechanism 7 is formed of, for example, the circular belt 7*a* disposed in the housing 10 of the ink jet printer 1 along the main-scanning direction and a DC motor 7*b* for driving the belt 7*a*. A part of the belt 7*a* is connected to the rear end portion of the carriage 2. By reciprocally driving the belt 7*a* with the DC motor 7*b*, the carriage driving mechanism 7 applies the driving force to the carriage 2 to reciprocate the carriage 2 in the main-scanning direction. The configuration of the carriage driving mechanism 7 is not limited to this.

The control circuit 9 is controlled by software such as a device driver operated in the external personal computer or the like. The control circuit 9 has a function of printing an image or images on the recording paper sheet P or sheets P1 and P2 by controlling the sheet conveying mechanism 6, the carriage driving mechanism 7 and the recording head on the basis of data and commands transmitted from the personal computer. The control circuit 9 also may have a function of decompressing JPEG compressed image data transmitted from a digital camera or the like and forming an image on the recording paper sheet. The control circuit 9 may be configured so as to allow a predetermined function to be performed by operating an operational button (not shown) provided at the housing 10 by the user.

Subsequently, the printing operation at the time when the ink jet printer 1 forms an image on a recording paper sheet P will be described. When the printing operation starts, the substantially circular surface of the pick roller 5 is brought into contact with the upper surface of the recording paper sheet P mounted on the paper sheet feed tray 11 and the pick roller 5 is rotated. Thus, one recording paper sheet P is picked and fed toward the inside of the housing 10. The picked recording paper sheet P is conveyed in the sub-scanning direction by the recording paper sheet conveying mechanism 6. In this connection, ink drops are discharged toward the recording paper sheet P from the recording heads while the carriage 2 is reciprocated in the main-scanning direction by the carriage driving mechanism 7. By applying the ink drops to the recording paper sheet P in the main-scanning direction while conveying the recording paper sheet P in the sub-scanning direction in a repeated manner, an image is formed on the recording paper sheet P. When the image is formed on the recording paper sheet P, the recording paper sheet P is ejected to the paper sheet exit tray 12 by the recording paper sheet conveying mechanism 6 and the printing operation is completed.

In this embodiment, the paper sheet feed tray 11 is detachably attached to the housing 10. The ink jet printer 1 is configured so that the paper sheet feed tray 11 may be detached from the housing 10 and a paper sheet feed tray other than the paper sheet feed tray 11 also may be attached to the housing 10.

Figure 2:
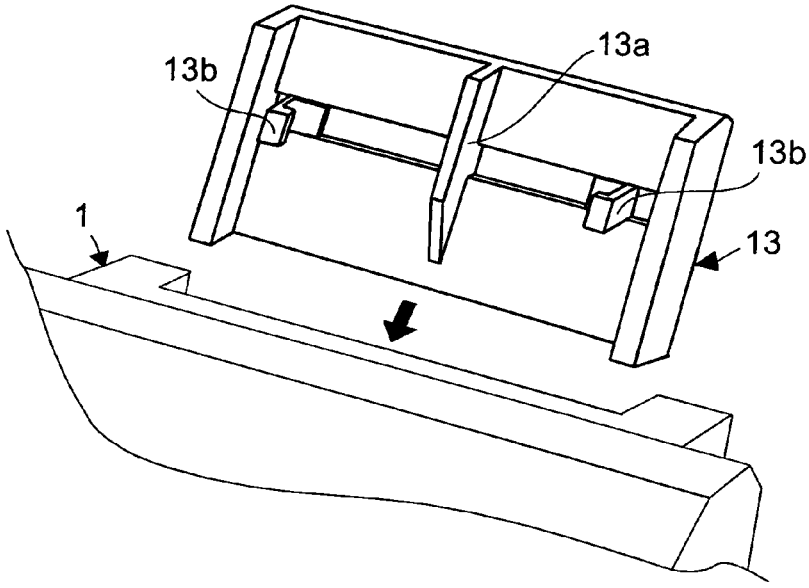
FIG. 2 is a perspective view showing a configuration of a parallel paper sheet feed tray attached to the printer.

FIG. 2 shows a parallel paper sheet feed tray 13 other than the above-mentioned paper sheet feed tray 11. In this embodiment, the paper sheet feed tray 11 and the parallel paper sheet feed tray 13 can selectively be attached to the housing 10 by inserting the selected tray into a slot formed in the rear face side of the housing 10 as shown by an arrow in FIG. 2. The parallel paper sheet feed tray 13 is provided with a partition 13*a* for partitioning an area in which the recording paper sheet is mounted into two nearly equally at the almost center in the main-scanning direction. Guide claws 13*b* are provided on both sides of the partition 13*a*, respectively, so as to be slidable in the main-scanning direction.

Figure 3:
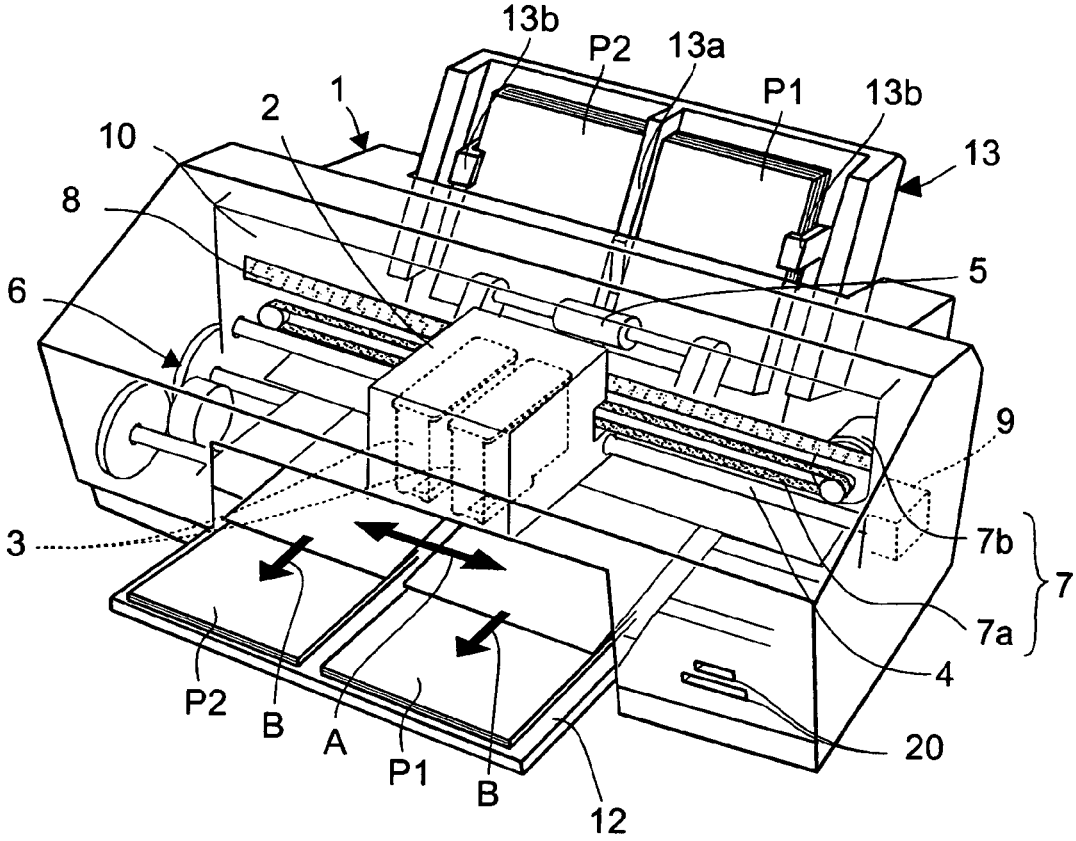
FIG. 3 is a perspective view showing a state where the parallel paper sheet feed tray is attached to the printer.

FIG. 3 shows the ink jet printer 1 in a state where the parallel paper sheet feed tray 13 in place of the paper sheet feed tray 11 is attached to the housing 10. As shown in FIGS. 2 and 3, recording paper sheets P1 and P2 such as postcards, which are smaller than the above-mentioned recording paper sheet P, are mounted on both sides of the partition 13*a* in parallel in the main-scanning direction so as to place the partition 13*a* therebetween. The recording paper sheets P1 and P2 are held closer to the partition 13*a* by the respective guide claws 13*b*. The ink jet printer 1 is further configured to be available for recording paper sheets such as cards, envelopes and at a maximum, sheets of A6 size which is substantially half of A4 size in width as the recording paper sheets P1 and P2. Such recording paper sheets P1 and P2 can be mounted in the parallel paper sheet feed tray 13 in the longitudinal direction.

In this manner, when the parallel paper sheet feed tray 13 is attached to the housing 10, the control circuit 9 controls the operation of printing images on the two recording paper sheets P1 and P2 at the same time. Hereinafter, the parallel printing operation performed under control of the control circuit 9 will be described.

When the parallel printing operation starts, the substantially cylindrical surface of the pick roller 5 is brought into contact with upper surfaces of the recording paper sheet P1 and P2 which are mounted on the parallel paper sheet feed tray 13 in two rows in parallel. Then, the pick roller 5 is rotated so as to pick the recording paper sheets P1 and P2 one by one simultaneously and to feed them toward the inside of the housing 10. The two picked recording paper sheets P1 and P2 are conveyed in the sub-scanning direction by the recording paper sheet conveying mechanism 6 under a state where the recording paper sheets P1 and P2 are arranged in parallel in the main-scanning direction. In this connection, ink drops are discharged from the recording head to the recording paper sheets P1 and P2 while the carriage 2 is reciprocated by the carriage driving mechanism 7 in the main-scanning direction. At this time, the carriage 2 is driven so as to apply the ink drops to both the recording paper sheets P1 and P2 during one reciprocating motion in the main-scanning direction and thus images are formed on the two recording paper sheets P1 and P2, simultaneously. Then, the two recording paper sheets P1 and P2 are exited on the paper sheet exit tray 12 by the recording paper sheet conveying mechanism 6 as shown in FIG. 3, and the parallel printing operation is completed.

In addition, the device driver of the external personal computer or the like forms data of a large image where an original image to be formed on both the recording paper sheets P1 and P2 is copied and the original and copied images are arranged in parallel in two rows in the main-scanning direction, and the data of the large image is transmitted to the ink jet printer 1. In the ink jet printer 1, this large image is printed on the two conveyed recording paper sheets P1 and P2 under control of the control circuit 9, so that the same images are formed on the recording paper sheets P1 and P2, respectively.

Alternatively, the control circuit 9 may have a function of forming data of a large image where an original image to be formed on both the recording paper sheets P1 and P2 is copied and the original and copied images are arranged in parallel in two rows in the main-scanning direction. In this case, only the data of the original image is transmitted from the external personal computer or the like to the ink jet printer 1 as conventional.

Still alternatively, the ink jet printer 1 may be configured so as to form different images on the recording paper sheets P1 and P2, respectively. In this case, the device driver of the external personal computer or the like transmits data of two different images to be printed on the two recording paper sheets P1 and P2, respectively, to the ink jet printer 1. The control circuit 9 performs the parallel printing operation of forming the two different images on the recording paper sheets P1 and P2, respectively.

Since the images are formed on the two recording paper sheets P1 and P2 simultaneously by using the parallel paper sheet feed tray 13 in this manner, time required for sheet feeding and sheet exiting operations for the recording paper sheets becomes shorter. Thus, time necessary for forming the images on the recording paper sheets becomes shorter, and thereby, the image forming operation can be finished within a short time.

Furthermore, since the recording paper sheets P1 and P2 are mounted in the parallel paper sheet feed tray 13 in two rows in parallel, more recording paper sheets P1 and P2 can be mounted all together, in comparison with the conventional ink jet printer. Thus, even when images are formed on a lot of recording paper sheets P1 and P2, it is possible to reduce the number of times the recording paper sheets P1 and P2 are filled in the parallel paper sheet feed tray 13, thereby improving the convenience of the ink jet printer 1.

Still furthermore, since both the parallel paper sheet feed tray 13 and the paper sheet feed tray 11 can be attached to and detached from the housing 10, the ink jet printer 1 can be put to various uses by choosing the parallel paper sheet feed tray 13 or the paper sheet feed tray 11 depending applications such as size of the recording paper sheet.

Still furthermore, since the parallel paper sheet feed tray 13 is formed by merely adding the partition 13*a* to the paper sheet feed tray 11, the configuration of the ink let printer 1 and the parallel paper sheet feed tray 13 become simple and manufacturing costs of them can be reduced. As a result, it is possible to provide a printer capable of forming images on two recording paper sheets simultaneously at low costs.

The ink jet printer in accordance with the present invention is not limited to the above-mentioned description and illustration of the attached drawings. The ink jet printer may comprises at least a carriage which mounts at least a recording head for discharging ink drops and is provided in a housing so as to be movable in a main-scanning direction, a carriage driving mechanism for reciprocating the carriage in the main-scanning direction, a paper sheet feed tray for mounting recording paper sheets thereon, having a partition which partitions an area where the recording paper sheets are mounted into two in the main-scanning direction and enabling the recording paper sheets to be mounted in two rows in parallel in the main-scanning direction with the partition being placed therebetween, and a recording paper sheet conveying mechanism for conveying the recording paper sheets mounted on the paper sheet feed tray in two rows one by one per row in a sub-scanning direction perpendicular to the main-scanning direction under a state arranged in parallel in the main-scanning direction.

It is preferable that the sheet feed tray can be attached to and detached from the housing, and the sheet feed tray and another sheet feed tray having no partition are selectively attached to the housing.

Furthermore, it is preferable that a pick roller for picking the recording paper sheets one by one per row from the paper sheet feed tray is provided in the housing at the almost center of the paper sheet feed tray in the main-scanning direction so as to be opposed to the recording paper sheets mounted on the paper sheet feed tray.

Still furthermore, it is preferable further to comprise a control circuit for controlling image forming operation, and the control circuit uses data of a large image transmitted from a host where an original image to be formed on both the recording paper sheets is copied and the original and copied images are arranged in parallel in two rows in the main-scanning direction.

Alternatively, it is preferable further to comprise a control circuit for controlling image forming operation, and the control circuit has a function of forming data of a large image where an original image to be formed on both the recording paper sheets is copied and the original and copied images are arranged in parallel in two rows in the main-scanning direction.

Still alternatively, it is preferable further to comprise a control circuit for controlling image forming operation, and the control circuit has a function of parallel printing operation of forming two different images on the recording paper sheets respectively with using data of two different images to be printed on the two recording paper sheets respectively which are transmitted from a host.

Furthermore, it is preferable that the recording head is provided on an ink cartridge mounted on the carriage.

This application is based on Japanese patent application 2005-311796 filed Oct. 26, 2005 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An ink jet printer comprising:

a carriage, which mounts at least one ink cartridge for discharging ink drops, that is movable in a main-scanning direction;

a carriage driving mechanism for reciprocating the carriage in the main-scanning direction;

a housing in which the carriage is provided and to which a plurality of paper sheet feed trays are selectively insertable into a slot formed in a rear face side of said housing, one of said paper sheet feed trays being a parallel paper sheet feed tray for mounting recording paper sheets thereon having a partition that partitions an area where the recording paper sheets are mounted into two, substantially equally and substantially centrally, in the main-scanning direction, enabling the recording paper sheets to be mounted in two parallel rows in the main-scanning direction with the partition being placed therebetween;

a recording paper sheet conveying mechanism configured to convey the recording paper sheets mounted on the parallel paper sheet feed tray in said two rows, one by one per row, in a sub-scanning direction perpendicular to the main-scanning direction and in a state parallel in the main-scanning direction;

a pick roller, provided in the housing substantially centrally of the paper sheet feed tray so as to face the partition, defining a cylindrical surface that is brought into contact at the same time with upper surfaces of the recording paper sheets mounted in said two parallel rows; and a control circuit for controlling an image forming operation;

wherein the control circuit forms data of a large image where an original image to be formed on both the recording paper sheets is copied and the original and copied images are arranged in parallel in said two rows in the main-scanning direction when the parallel paper sheet tray is attached to the housing.

2. The ink jet printer in accordance with claim 1, wherein the one of the paper sheet feed and another of the paper sheet feed trays having no partition are selectively insertable into said slot and attached to the housing.

3. The ink jet printer in accordance with claim 1, wherein the control circuit further uses data of a large image transmitted from a host where an original image to be formed on both the recording paper sheets is copied and the original and copied images are arranged in parallel in said two parallel rows in the main-scanning direction.

4. The ink jet printer in accordance with claim 1, wherein the control circuit further forms two different images on the recording paper sheets respectively using data of two different images to be printed on the two recording paper sheets that are transmitted from a host.

5. The ink jet printer in accordance with claim 1, wherein the at least one ink cartridge is provided with a recording head.

6. The ink jet printer in accordance with claim 1, wherein the parallel paper sheet feed tray has a pair of guide claws provided on each side of the partition, and wherein each of the guide claws is slidable in said main-scanning direction.

* * * * *